United States Patent [19]

Perrault

[11] 4,253,245

[45] Mar. 3, 1981

[54] DEVICE FOR CONTROLLING THE FLOW OF STEAM IN PAPER MACHINE DRYERS

[75] Inventor: Robert D. Perrault, Titusville, N.J.

[73] Assignee: Union Camp Corporation, Wayne, N.J.

[21] Appl. No.: 77,122

[22] Filed: Sep. 19, 1979

[51] Int. Cl.[3] ..... F26B 13/08

[52] U.S. Cl. ..... 34/48; 34/119; 34/124

[58] Field of Search ..... 34/48, 119, 124, 125; 165/90, 91

[56] References Cited

U.S. PATENT DOCUMENTS

| | | | |
|---|---|---|---|
| 2,992,493 | 7/1961 | Fishwick | 34/48 |
| 3,251,138 | 5/1966 | Whittaker | 34/48 |
| 4,106,211 | 8/1978 | Holik | 34/124 |

*Primary Examiner*—Larry I. Schwartz

*Attorney, Agent, or Firm*—Kane, Dalsimer, Kane, Sullivan and Kurucz

[57] ABSTRACT

This disclosure is of a device for controlling the flow of steam in paper machine dryers wherein a positive displacement pump is used to create differential and condensate evacuation from the paper machine dryers. This invention is applicable to a single steam heated drum or a plurality of such drums. It can be used in either a recirculating or cascading system.

5 Claims, 2 Drawing Figures

DEVICE FOR CONTROLLING THE FLOW OF STEAM IN PAPER MACHINE DRYERS

BACKGROUND OF THE INVENTION

1. Field of the Invention

The invention relates to steam heated dryer drums in a paper machine and more particularly to a flow control system for controlling the flow of steam through a dryer using a positive displacement pump to create differential and condensate evacuation from the paper machine dryers.

2. Brief Description of the Prior Art

For many years the advantages of flow control for dryer drainage systems have been known and discussed. U.S Pat. No. 2,869,248 discloses a device for controlling the flow of steam through a dryer drum in a paper machine. U.S. Pat. No. 2,992,493 discloses a dryer and drainage system by providing a flow control on the downstream side of the drying rolls which operates to automatically maintain the steam flow through each of the rolls or cylinders at a predetermined minimum quantity regardless of the varying load conditions on the rolls. Use of an orifice plate is an absolute necessity in the prior state of the art.

The present invention embodies a positive displacement pump (gas pump) which gives the system distinct advantages and benefits not found in the systems of the prior art. None of such prior art systems employ positive displacement pumps. The pump used herein is a conventional rotary positive blower of the type developed by the Roots brothers and sold by several manufacturers.

SUMMARY OF THE INVENTION

The drying section of a paper machine generally includes one or a series of dryer drums, each of which has a cylindrical shell, spaced heads extending across the shell to close the open ends thereof, journals for rotatively mounting the shell, conduits for introducing steam into the shell and conduits for withdrawing steam condensate from the shell. When multiple dryers are used the paper web travels from one of these dryer drums to the others in such a drying section.

This invention is applicable to a single steam heated drum or a plurality of such drums for the manufacture of materials such as paper.

Although this method of control can be used for the control of steam in various other devices, it is particularly well suited for use with paper machine dryers.

Each dryer is a coded pressure vessel cylindrical in shape. Steam is admitted through the journal at one end of the rotating cylinder. Condensed steam is then removed through a radial pipe and shoe fitted to the inner surface of the dryer drum. Heat given up from the condensing steam dries the paper passing over the outer surface of the dryer. Steam pressure can vary from 0 to 160 pounds per square inch inside the dryer(s). Differential Pressure is created across the dryer(s) to whatever is required in order to entrain and evacuate the condensed steam and maintain the best possible heat transfer across the dryer shell.

Problems with the present differential method of control is that a set differential is no guarantee that it will be sufficient to evacuate the condensate under all conditions and flooding of dryers can occur. A set differential can also mean large amounts of steam loss during a sheet break or other upset conditions. These problems are eliminated with the present invention using a positive displacement pump, which provides a constant volumetric flow at all operating conditions including upset conditions. This is not possible with any other known method of control without multiple adjustments. Requirements for a thermocompressor is also eliminated with the use of a positive displacement pump.

The dryer and drainage system of the present invention comprises:

- at least one dryer section, each section having at least one dryer pump;
- means for feeding steam into the dryer section;
- a device for controlling the pressure of steam into the dryer section;
- a separator connected to the dryer section for drawing off steam and condensate therefrom, said separator maintaining a condensate level therein;
- a pipe connected to said separator above the condensate level for drawing off "blowthru" steam therefrom; and
- a variable speed gas pump to which the said pipe is connected, said pump being set to a predetermined speed to control the desired rate of flow of steam through the system.

DETAILED DESCRIPTION OF THE PREFERRED EMBODIMENTS OF THE INVENTION

Figure 1:
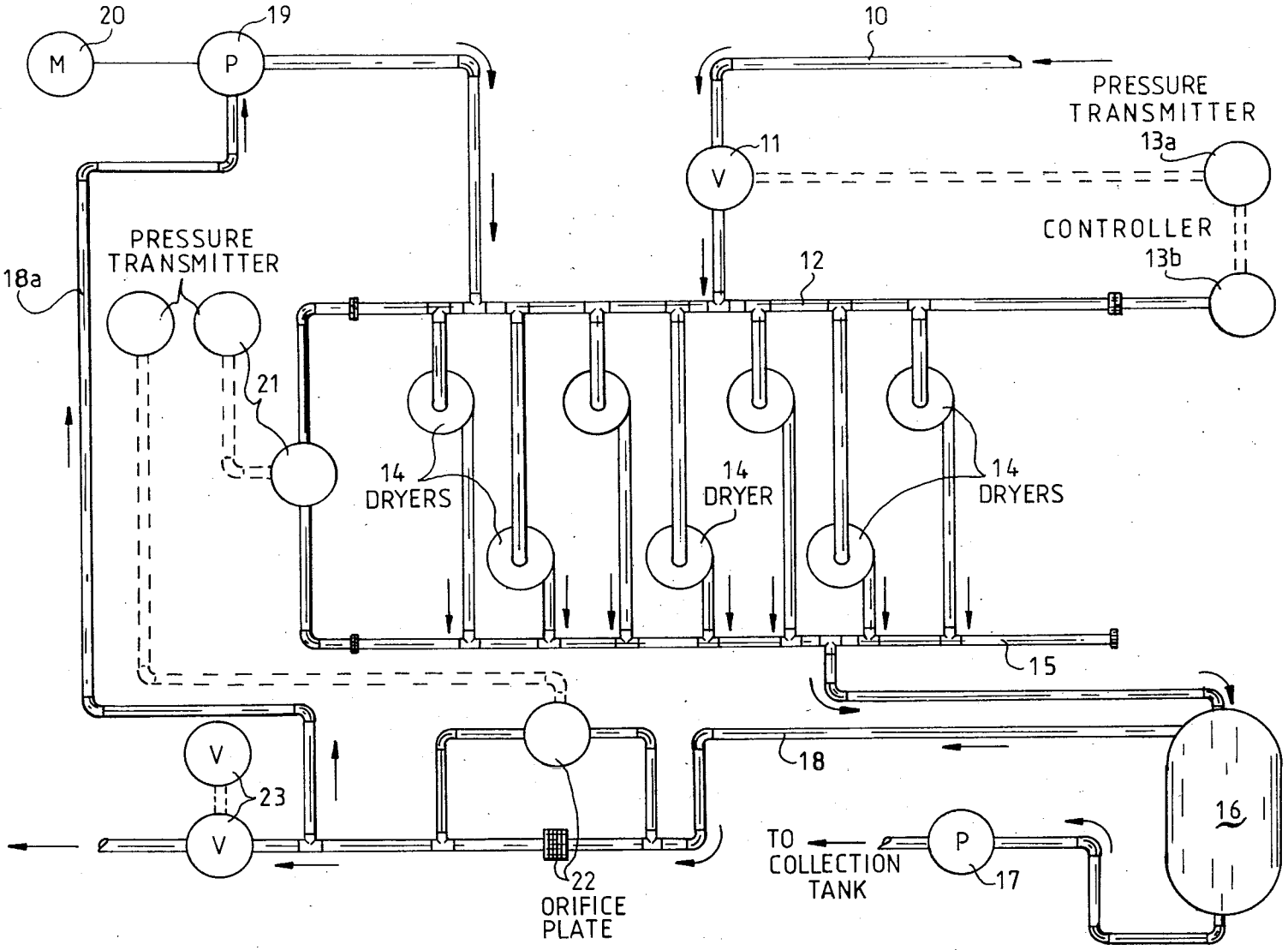
FIG. 1 is a schematic diagram showing a recirculating system layout embodying the present invention.

Referring to FIG. 1 the main steam supply is fed through a pipe 10 into a pressure control valve 11, which controls the steam pressure and quantity going to the dryers, which pressure and quantity are established by the requirements to dry the paper passing over the dryers. The steam passes from the control valve 11 to a main steam supply header 12 which feeds the steam to the dryer or dryers in the dryer section. The pressure to the main steam supply header 12 is controlled by the pressure transmitter **13*a* and controller 13*b* in conjunction with the control valve 11. The steam then passes from the header 12 to the dryer or dryers 14 in the section where most of it condenses. A mixture of steam and condensate flows out of the dryers to a condensate header 15. This mixture of steam and condensate is then separated in a separator tank 16. The condensate is removed from the bottom of the separator by a condensate pump 17 to a common collection tank. The blowthru steam required to entrain and evacuate the condensate from the dryers is then pulled from the top of the separator through a line 18 by a positive displacement pump 19 powered by a motor 20. Such motor can be a variable speed drive, belt drive or direct gear reducer drive. The positive displacement pump provides a predetermined, fairly constant volumetric flow over its entire range of pressure operation and under all upset conditions including sheet break. The differential steam pressure created between header 12 and line 18, is recompressed by the positive displacement pump 19 and returned to the original operating pressure into steam header 12**.

The differential pressure transmitter 21 is not required for the proper operation of this system, but is used as an indication of differential and for trouble shooting purposes such as detecting broken syphons or flooded dryers. The orifice plate 22 and associated transmitter is also not necessary for the operation of this system, but is included for monitoring flow and used as a trouble shooting tool. Valve 23 is required to purge the dryers of noncondensibles, such as at startup or as required during operation. This valve can be on manual or automatic control.

Figure 2:
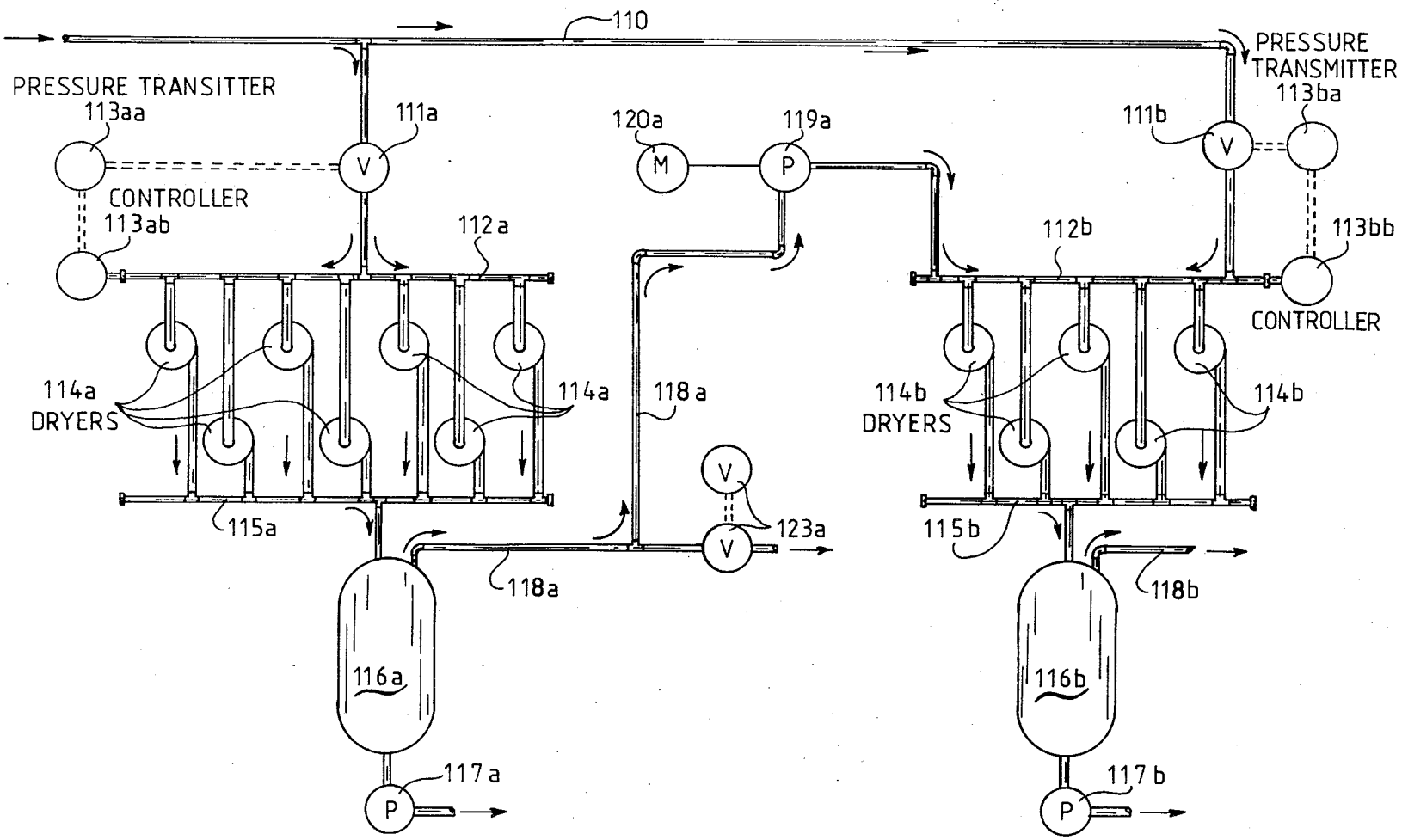
FIG. 2 is a schematic diagram showing a cascading system layout embodying the present invention.

Whereas FIG. 1 illustrates the use of the present invention in a recirculating system, FIG. 2 illustrates the use of the present invention in a cascading system.

Referring to FIG. 2 the main steam supply is fed through a pipe 110 into a plurality of sections each with one or a plurality of dryers through pressure control valves 111*a*, 111*b* with one valve for each section. The units of each section are designated with the same letter following the number for the unit, i.e., the units in the first section are designated with the letter a, in the second section with the letter b, etc. The valves control the steam pressure and quantity going to the dryers. The steam passes from the control valves 111*a*, 111*b* to main steam supply headers 112*a*, 112*b* which feed the steam to the dryer or dryers in each dryer section. The pressure to the main steam supply headers 112*a*, 112*b* is controlled by the pressure transmitters 113*aa*, 113*ba* and controllers 113*ab*, 113*bb* in conjunction with the control valves 111*a*, 111*b*. The steam then passes from the headers 112*a*, 112*b* to the dryers 114*a*, 114*b* in the sections where most of it condenses. A mixture of steam and condensate flows out of the dryers to condensate headers 115*a*, 115*b*. This mixture of steam and condensate is then separated in separator tanks 116*a*, 116*b*. The condensate is removed from the bottoms of the separators by condensate pumps 117*a*, 117*b* to a common collection tank. The blowthru steam required to entrain and evacuate the condensate from the dryers is then pulled from the tops of the separators through lines 118*a*, 118*b* by a positive displacement pump 119*a* powered by motor 120*a*. Such motor can be a variable speed drive, belt drive or direct gear reducer drive. The positive displacement pump provides a predetermined, fairly constant volumetric flow over its entire range of pressure operation and under all upset conditions including sheet break. The differential steam pressure created between headers 112*a* and 118*a*, is recompressed by the positive displacement pump 119*a* and returned to the operating pressure selected for the steam header 112*b* in the succeeding section. For additional sections the various units heretofore described are repeated to take care of the dryers in each section. In such case there will be a positive displacement pump added for each section which will operate in the same manner as the pump 119*a* described above.

There is very little difference between the recirculating and cascading system. Both systems allow all the dryers to operate at the maximum pressure possible. The cascading system has the added advantage of being able to greatly reduce the energy required to create the differential by allowing the receiving section to operate at a lower pressure than the cascading section. The differentials cannot get to be excessive as with present day systems when cascading because the positive displacement pump acts as a metering device.

Valve 123*a* is required to purge the dryers of noncondensibles, such as at startup or as required during operation. These valves can be on manual or automatic control.

The present invention using a positive displacement pump to create differential and condensate evacuation from paper machine dryers has the following distinct advantages over the flow control and other standard systems heretofore in use:

1. This system greatly advances the state of the art for evacuating condensate from steam heated rolls used to dry materials such as paper products.
2. This system greatly reduces the amount of energy required to evacuate the condensate from the dryer rolls. Only that energy required to maintain the set volumetric flow is used. At normal operating condition, this energy requirement is low compared to design.
3. The positive displacement pump produces better than 95% of the brake horsepower in the form of heat of compression. This heat of compression is practically all recovered and reused in the form of heat to the drying cylinder.
4. This method of control provides for a floating differential pressure across the dryer(s), without use of the prior art orifice plate and transmitter.
5. The floating differential provides for automatic adjustments and control for changing dryer conditions more accurately than previously possible.
6. This floating differential automatically compensates for changes in the condensing load, speed or effect of centrifugal force, and sheet break or other upset conditions without blowing steam to the atmosphere.
7. Differential across the dryer can be greatly reduced resulting in higher equivalent steam pressure in a cascading system.
8. The use of high pressure motive steam is eliminated along with the thermocompressors.
9. There is no more steam loss during sheet break or other upset conditions, either to the atmosphere or heater exchanger. The positive displacement pump actually meters the flow of steam. This is especially advantageous during periods of low condensing load such as sheet break.
10. A dryer drainage heat exchanger is no longer required on a paper machine.
11. Erosion of steamfit parts and piping is greatly reduced due to the lower resulting differential pressure and metering effect preventing excessive differentials.
12. Excessive dryer journal temperature especially during sheetbreak with a thermocompressor system can be eliminated.
13. Faster uptime following a break has been achieved, resulting in lower reject rates.
14. The positive displacement pump advances the state of the art well beyond the use of flow control because of the fairly constant volumetric flow provided by the positive displacement pump over its entire normal range of operation, from −20 inches mercury vacuum to 160 PSIG.

What is claimed:

1. In a dryer and drainage system including at least one dryer section, each section having at least one dryer drum, a device for controlling the flow of steam through each section comprising:

means for feeding steam into the dryer section;

a device for controlling the pressure of steam into the dryer section;

a separator connected to the dryer section for drawing off steam and condensate therefrom;

said separator maintaining a condensate level therein;

a pipe connected to said separator above the condensate level for drawing off blowthru steam therefrom; and a gas pump to which the said pipe is connected, said pump being positioned between the said separator and the dryer section and being set to a predetermined speed to control the desired rate of flow of steam from the said separator into the dryer section;

whereby the required pressure differential for all conditions is automatically controlled.

2. The device of claim 1 wherein there are a plurality of sections with each section having at least one dryer drum.

3. The device of claim 1 wherein the gas pump has a variable speed drive whereby the desired rate of flow of steam can be varied.

4. The device of claim 1 wherein the steam from the separator is fed by the gas pump back to the means for feeding steam into the dryer section whereby the steam is recirculated through the dryer section.

5. The device of claim 2 wherein the steam from the separator of the first dryer section is fed by the gas pump to the means for feeding steam into the second dryer section whereby the steam is cascaded from one section to the next section.

* * * * *